US006805834B2

(12) United States Patent
Thut

(10) Patent No.: US 6,805,834 B2
(45) Date of Patent: Oct. 19, 2004

(54) PUMP FOR PUMPING MOLTEN METAL WITH EXPANDED PISTON

(76) Inventor: Bruno H. Thut, 16755 Park Cir. Dr., Chagrin Falls, OH (US) 44023

( * ) Notice: Subject to any disclaimer, the term of this patent is extended or adjusted under 35 U.S.C. 154(b) by 62 days.

(21) Appl. No.: 10/253,567

(22) Filed: Sep. 25, 2002

(65) Prior Publication Data

US 2004/0056395 A1 Mar. 25, 2004

(51) Int. Cl.[7] ..... C21C 5/48
(52) U.S. Cl. ..... 266/239; 164/312; 417/53
(58) Field of Search ..... 266/239; 164/337, 164/312; 417/53

(56) References Cited

U.S. PATENT DOCUMENTS

| | | | | |
|---|---|---|---|---|
| 274,104 | A | | 3/1883 | Ayres |
| 350,761 | A | | 10/1886 | Neff |
| 1,689,698 | A | | 10/1928 | Tornberg |
| 1,736,188 | A | | 11/1929 | Daesen et al. |
| 1,954,775 | A | | 4/1934 | During et al. |
| 2,195,360 | A | | 3/1940 | Daesen |
| 2,372,603 | A | | 3/1945 | Pilkington |
| 2,390,263 | A | | 12/1945 | Mills |
| 2,837,792 | A | | 6/1958 | Ring |
| 3,015,849 | A | | 1/1962 | Mittelstadt et al. |
| 3,209,418 | A | | 10/1965 | Smith |
| 3,319,702 | A | | 5/1967 | Hartwig et al. |
| 3,467,171 | A | | 9/1969 | Fulgenzi et al. |
| 3,515,203 | A | | 6/1970 | Parlanti et al. |
| 3,533,464 | A | | 10/1970 | Parlanti et al. |
| 3,585,095 | A | | 6/1971 | Fulgenzi |
| 3,672,440 | A | | 6/1972 | Miura et al. |
| 3,701,378 | A | | 10/1972 | Graham |
| 4,248,289 | A | | 2/1981 | Perrella et al. |
| 4,252,176 | A | | 2/1981 | Page |
| 4,991,641 | A | | 2/1991 | Kidd et al. |
| 5,012,856 | A | | 5/1991 | Zecman |
| 5,375,646 | A | | 12/1994 | Stummer et al. |
| 5,388,633 | A | | 2/1995 | Mercer, II et al. |
| 5,394,931 | A | | 3/1995 | Shiina et al. |
| 5,454,423 | A | | 10/1995 | Tsuchida et al. |
| 5,630,464 | A | | 5/1997 | Bauman et al. |
| 6,152,691 | A | * | 11/2000 | Thut ..... 415/197 |
| 6,187,096 | B1 | * | 2/2001 | Thut ..... 118/300 |
| 6,293,759 | B1 | | 9/2001 | Thut |
| 6,533,535 | B2 | * | 3/2003 | Thut ..... 415/1 |

* cited by examiner

*Primary Examiner*—Scott Kastler
(74) *Attorney, Agent, or Firm*—Pearne & Gordon LLP

(57) ABSTRACT

A pump for pumping molten metal includes a pump base comprised of non-metallic, heat resistant material. The pump base comprises an inlet opening, a wall that forms a pumping chamber, a passageway that communicates the inlet opening with the pumping chamber, and an outlet opening that communicates with the pumping chamber. A piston comprising non-metallic, heat resistant material is disposed in the pumping chamber. The wall comprises non-metallic, heat resistant material. A connecting member is fastened to the piston. A valve permits and restricts flow of molten metal in the pump base. An actuator is connected to the metal connecting member, the actuator being adapted for effecting reciprocal movement of the piston in the pumping chamber. The piston has a coefficient of thermal expansion and configuration effective to enable it to expand into contact with the wall during its reciprocal movement in the pumping chamber. When used in a die casting apparatus, also featured is a shot chamber disposed near the discharge opening for receiving molten metal discharged from the conduit. A ram is disposed in the chamber for injecting the molten metal in the chamber into a die for casting the molten metal.

17 Claims, 3 Drawing Sheets

PUMP FOR PUMPING MOLTEN METAL WITH EXPANDED PISTON

FIELD OF THE INVENTION

The present invention is directed to the field of pumps for pumping molten metal and, in particular, to using a pump for pumping molten metal into a shot sleeve for die casting metal parts. More specifically, the invention is directed to an apparatus for die casting high melting point alloys containing aluminum or magnesium and the like, and low melting point alloys such as those containing zinc.

BACKGROUND OF THE INVENTION

Metal parts may be produced using "cold chamber" and "hot chamber" die casting apparatuses. Cold chamber apparatuses employ a molten metal reservoir that is separated from the casting machine. Enough metal for one just casting is normally ladled by hand through a port of a small chamber referred to as a shot sleeve. Since this is done by hand it undesirably results in variation in the quantity of molten metal that is fed into the shot sleeve. A hydraulically actuated ram moves in the shot sleeve to force the molten metal under pressure into a die. As the ram advances, it seals the port and forces the charge into the die at pressures which may range from several psi to 60,000 psi or more. The molten metal cools in the chamber prior to injection into the die, thereby lending itself to description as a "cold chamber" process.

The hot chamber process is used for low melting point alloys such as zinc alloys and may employ, for example, a machine comprising a fixed cylinder having a spout firmly connected to a nozzle locked against a die cavity. A piston operating in the cylinder is raised to uncover an inlet port below the molten metal level in the pot. After the molten metal fills the interior of the cylinder, the piston is forced downward, which causes the molten metal to flow through the spout and into the die. Once the metal solidifies in the die the piston is withdrawn, the die is opened and the casting is removed. The die is then closed and the process repeated.

It is generally believed that better metallurgical castings result from use of the hot chamber process since the molten metal is not cooled as in the cold chamber process. However, numerous attempts have been made to develop a hot chamber apparatus for casting high melting point aluminum without widespread success. In view of difficulties presented in the hot chamber process, the industry could benefit from a cold chamber die casting apparatus which eliminates the risk of workers having to carry out the dangerous task of ladling molten metal, and from a process which produces an accurate charge of molten metal into the shot sleeve. An automated hot chamber die casting pump which is commercially usable is also desired.

SUMMARY OF THE INVENTION

In general, the present invention is directed to a pump for pumping molten metal. The pump includes a pump base comprised of non-metallic, heat resistant material. The pump base comprises an inlet opening, a wall forming a pumping chamber, a passageway that communicates the inlet opening with the pumping chamber, and an outlet opening that communicates with the pumping chamber. A piston made of non-metallic, heat resistant material is disposed in the pumping chamber. A connecting member is fastened to the piston. A valve permits and restricts flow of molten metal in the pump base. An actuator is connected to the connecting member and is adapted for effecting reciprocal movement of the piston in the pumping chamber. The piston has a coefficient of thermal expansion and configuration effective to enable it to expand into contact with the wall during its reciprocal movement in the pumping chamber.

One aspect of the invention relates to use of the inventive pump for die casting molten metal. The apparatus includes the aforementioned pump, a conduit extending from the outlet opening to a discharge location outside the base, and a device for injecting the molten metal into a die. The injection device includes a shot chamber that receives molten metal pumped from the conduit at the discharge location and a ram disposed in the shot chamber and adapted to direct molten metal in the shot chamber to a die for casting the molten metal. The conduit is either spaced from the shot chamber at the discharge location (e.g., cold chamber die casting) or the conduit is connected to the shot chamber at the discharge location (hot chamber die casting).

The invention resides in the use of a heat-expanded piston in the pump, which provides contact with the pump chamber wall resulting in more accurate charges and inhibition of molten metal from passing above the piston. This leads to improved safety and more effective performance. The pumping chamber wall and the piston comprise non-metallic, heat-resistant material such as ceramic material. Suitable ceramic material is selected from the group consisting of silicon carbide, silicon nitride and alumina. In one aspect of the invention, the connecting member comprises a material that expands more than the piston in the molten metal environment, thereby expanding the piston into contact with the pumping chamber wall.

Another aspect of the invention employs a piston comprised of a non-metallic, heat resistant material (e.g., ceramic) which has a coefficient of thermal expansion and configuration selected so as to expand the piston into contact with the pumping chamber wall. This device may employ a connecting member made of refractory material (e.g., the same material as the piston) in which case it does not expand more than the piston, or may utilize a connecting member which expands more than the piston as disclosed herein.

Referring to more specific features of the invention, a heat resistant gasket may be disposed in the pumping chamber. In one aspect of the invention the pumping chamber wall comprises an upper annular sleeve comprising non-metallic, heat resistant material disposed along a path of travel of the upper surface of the piston and a lower annular sleeve made of non-metallic, heat resistant material disposed below the upper cylindrical sleeve in the pumping chamber; a gasket comprised of heat-resistant material is disposed between the upper and lower sleeves. The piston moves along a predetermined axial region of the pumping chamber (i.e., stroke). In the first aspect of the invention, the metal connecting member engages the piston proximate to this region. That is, the contact between the connecting member and the piston is near an axial location in the pumping chamber where piston-sleeve contact is desired.

The present invention advantageously enables an accurate charge of molten metal to be delivered to the shot chamber, which improves the die casting process. In addition, the risk associated with ladling the molten metal by hand is avoided. The charge may be accurately varied as well, using stop member sleeves, a vertically movable stop plate and the like. The valve of the pump is advantageous in that it is a reliable and efficient way to regulate the charge into the pumping chamber.

The present invention is especially adapted for use in the cold chamber process, to replace the hand ladling that is often used. However, the present apparatus may be used in a hot chamber die casting process, by connecting the conduit with the shot sleeve or directly to a die without using a shot sleeve. In this case, a seal may be disposed around the piston that is suitable to enable sufficient pressure to be generated in the pumping chamber. In addition, the conduit may be heated or suitably insulated so as to prevent chilling of the molten metal prior to entering the die.

Many additional features, advantages, and a fuller understanding of the invention will be had from the accompanying drawings and the detailed description that follows.

DETAILED DESCRIPTION

Figure 1:
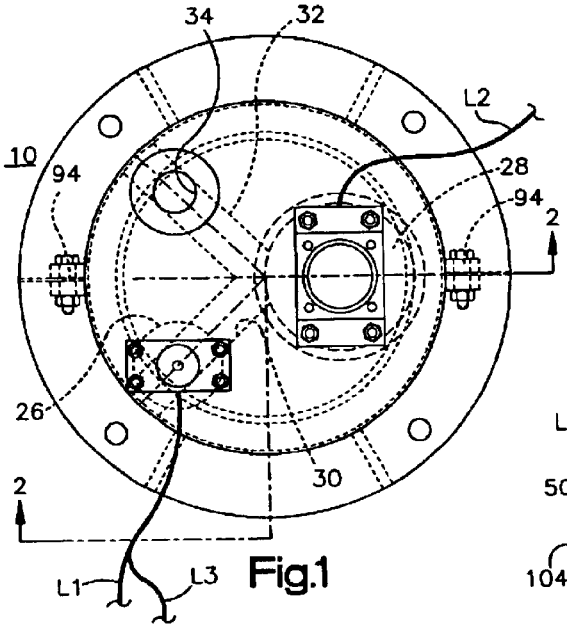
FIG. 1 is a top plan view of a pump for pumping molten metal constructed in accordance with the present invention.
Figure 2:
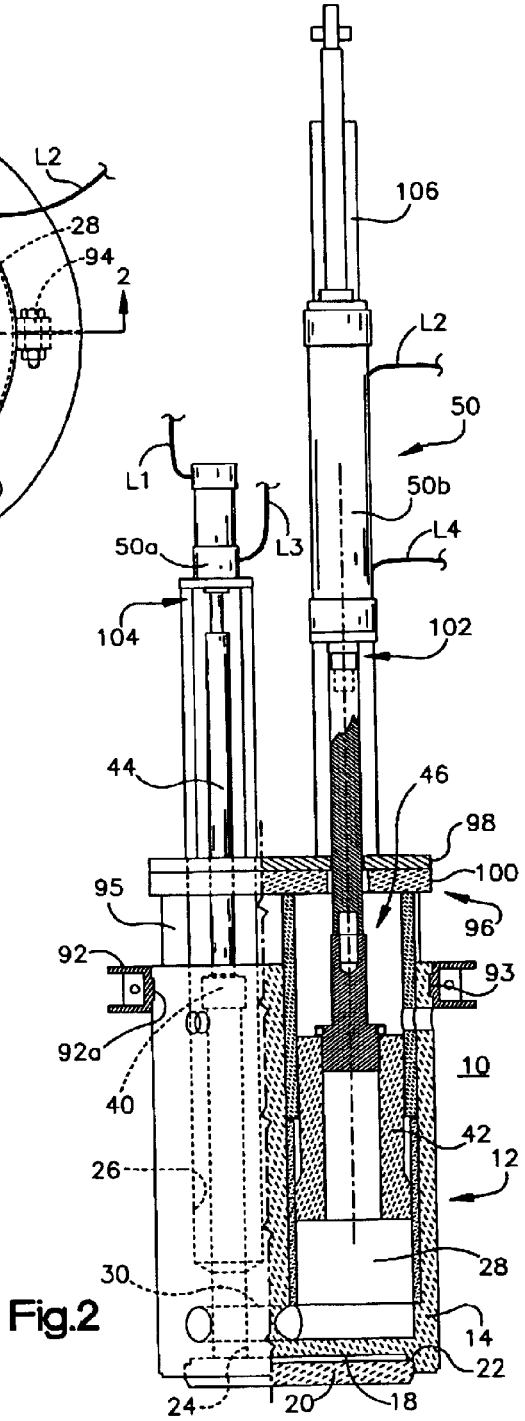
FIG. 2 is a view as seen along the plane designated 2—2 in FIG. 1.
Figure 3:
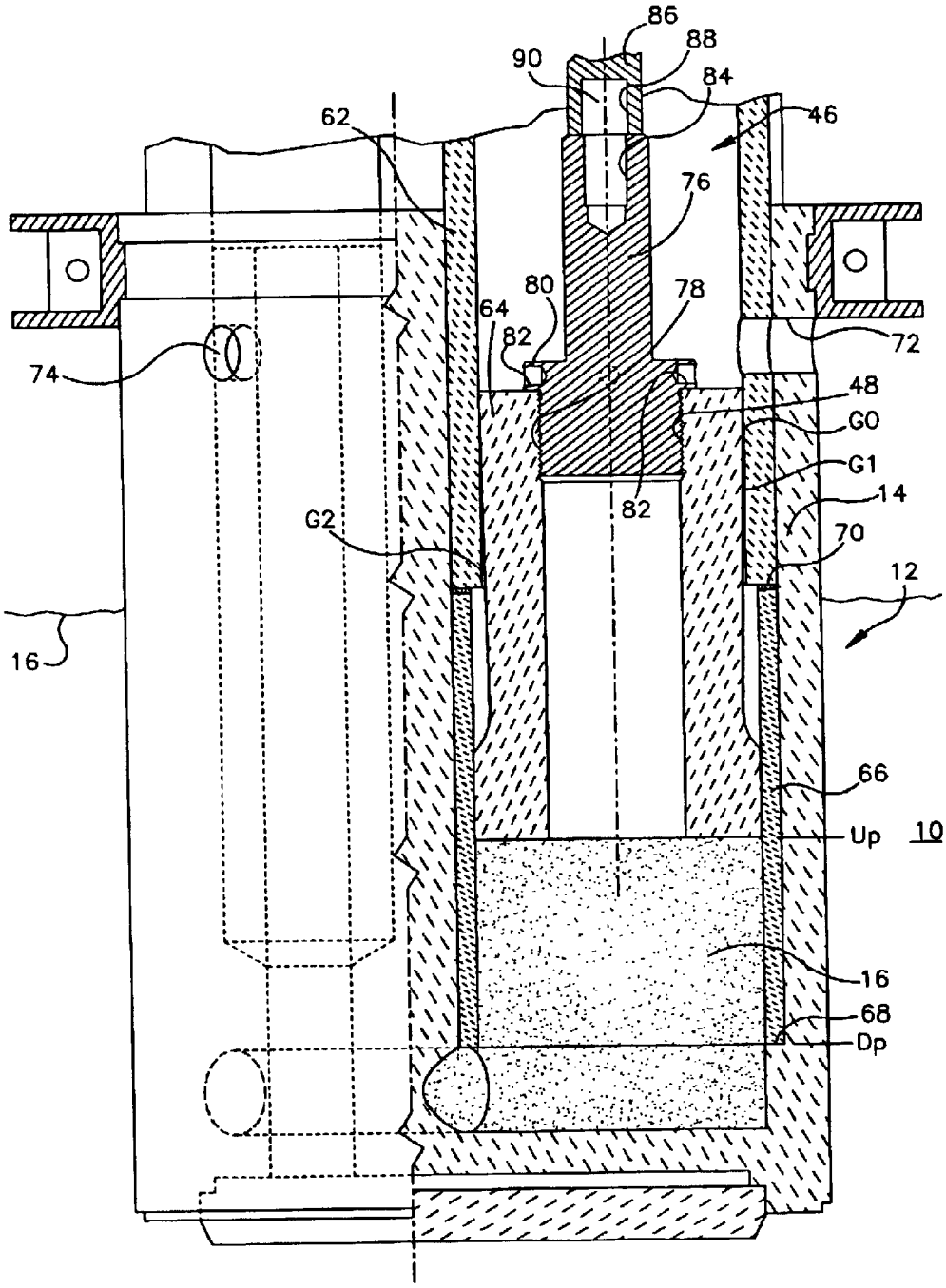
FIG. 3 is an enlarged, partial cross-sectional view of FIG. 2, showing the piston expanded against the sleeve in the pumping chamber.

Referring now to the drawings and to FIGS. 1–3 in particular, there is shown an apparatus 10 for die casting molten metal such as aluminum, the apparatus being of the "cold chamber" type, comprising a pump 12 including a pump base 14 disposed in a pot or bath of molten metal 16 (FIG. 3). The pump base is preferably a unitary block, comprised of non-metallic, heat resistant material such as graphite. There is a molten metal inlet opening 18 in the pump base, which in this aspect of the invention is covered by a filter 20 cemented on shoulder 22. An inlet passageway 24 leads from the inlet opening to a molten metal valve chamber 26. A molten metal pumping chamber 28 communicates, via passageway 30, with the valve chamber 26. The pumping chamber also communicates with a molten metal outlet opening 32. A conduit or discharge passageway 34 extends from the outlet opening 32 to any desired location and, in the case of the shot pump design, extends to a top surface of the base and can be extended to an outlet opening 36 near a discharge location 38 outside the bath.

A piston or valve 40 made of non-metallic, heat resistant material is adapted for reciprocal movement in the valve chamber and a piston or plunger 42 made of non-metallic, heat resistant material is adapted for reciprocal movement in the pumping chamber. Refer to U.S. Pat. No. 6,293,759, which is incorporated herein by reference in its entirety, for a discussion of a die casting pump having components suitable for use in the present invention including valve and chamber, pneumatic actuator and timing mechanism for reciprocal movement of the piston and valve in their respective chambers, as well as shot chamber and ram.

A valve connecting member 44 extends upwardly from and is connected to the valve and a piston connecting member 46 extends upwardly from and is connected to the piston. The piston connecting member 46 is received in an opening 48 formed in an upper surface of the piston (FIG. 3). In one aspect of the invention, the piston connecting member has a coefficient of thermal expansion and configuration relative to the piston effective to expand the piston against a sleeve (discussed below) when the piston is moving in the pumping chamber. That is, the piston connecting member is expanded by heat more than the heat resistant piston is. The piston connecting member is preferably cylindrical and received in the central opening or bore of the piston such as by being threaded to it, but may assume other shapes as well and may be received in the piston in other ways as apparent to those skilled in the art reading this disclosure. For example, the connecting member may have fingers received in grooves formed in the piston, may have a rectangular section received by a rectangular opening in the piston and may travel further down the length of the piston to effect expansion along the length of the piston, or selective expansion at certain axial locations of the piston. It is desirable to isolate the metal connecting member from the molten metal.

Alternatively, the composition (e.g., coefficient of thermal expansion) and configuration of the piston may be selected so that when immersed in molten metal the piston contacts the pumping chamber wall even without expansion by the connecting member forcing the piston to expand. In this case, the connecting member need not be formed of a material that expands more than the piston. A suitable design may utilize a connecting member comprising the same material as the piston to avoid stresses that may cause cracks in the piston due to excessive differences in thermal expansion between the connecting member and piston.

Figure 4:
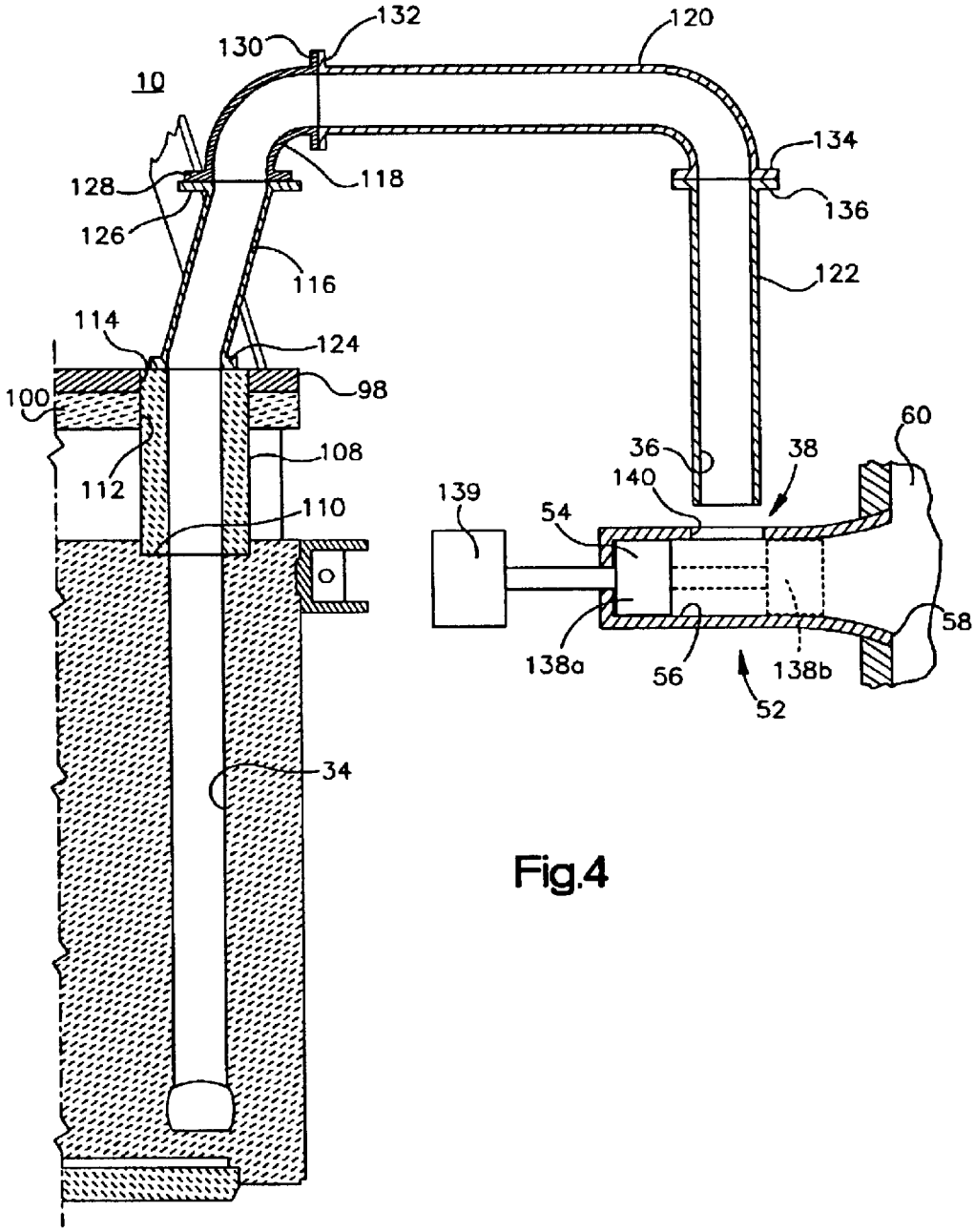
FIG. 4 is a schematic view of a shot pump used with the inventive pump for die casting metal parts.

At least one actuator 50 (FIG. 2) moves the valve and piston connecting members so as to effect the reciprocal movement of the valve and piston. A shot sleeve 52 (FIG. 4) is disposed near the discharge opening for receiving molten metal discharged from the conduit. A ram 54 disposed in a chamber 56 of the shot sleeve is adapted to direct molten metal in the chamber into an opening 58 of a die 60 for casting the molten metal into desired parts.

In the pumping chamber bore an upper sleeve 62 is positioned along the path of travel of the upper portion 64 of the piston, and a lower sleeve 66 is disposed below the upper sleeve (FIG. 3). The lower sleeve is supported on a shoulder 68 in the pump base. The sleeves may be cemented to the base using known refractory cement. At least one gasket 70 made of non-metallic, heat-resistant material may be cemented between the upper and lower sleeves. One suitable annular gasket is a Fiber Frax™ brand gasket. The gasket may have any suitable thickness (e.g., ⅛ inch). While not wanting to be bound by theory, in the first embodiment the upper portion of the piston 64 is believed to exhibit the most pronounced thermal expansion in view of the proximity of the thermally expandable connecting member. While not wanting to be bound by theory, this may lead to substantially no gap (GO) at the upper portion of the piston, a first gap G1 beneath the upper portion of the piston, and another larger gap G2 below G1. In this embodiment, the upper portion of the piston does not travel below the upper sleeve. Of course, the upper and lower sleeves may be made as a unitary member if desired. However, due to different wear on the upper and lower sleeves or to facilitate placement of the gasket, it is advantageous to use two sleeves. In the design where expansion is based only or primarily upon the coefficient of thermal expansion of the piston (not where the connecting member expands the piston), expansion may be uniform along the entire (or selected) length of the piston.

More specifically, in the first aspect of the invention heat-induced expansion of the piston connecting member outwardly against the piston (as in the case of a metal, piston connecting member and refractory piston), causes the piston to expand against the upper sleeve. The extent of the force by which the piston contacts the sleeve in the pumping chamber may be changed as desired by varying the composition of the material of the connecting member, the piston, the sleeve and/or the base so as to change the relative expansion of these components once they are subjected to the molten metal environment (e.g., high temperature). Also, the configuration of one or more of these components (e.g., shape and/or size thereof) may affect the extent of expansion and may also be changed.

The upper sleeve, lower sleeve and piston may be made of a wear-resistant ceramic material, e.g., silicon carbide (SiC), silicon nitride ($Si_3N_4$) and alumina ($Al_2O_3$) or other suitable heat and wear-resistant material known to one skilled in the art in view of this disclosure. In the first aspect of the invention, the piston connecting member may comprise metal (e.g., steel), or non-metallic heat conductive material, such as nonmetallic materials containing particles, fibers or whiskers made of conductive materials, including nonmetallic or metal-containing composite materials, so long as the material of the piston connecting member has a significantly higher thermal expansion coefficient and configuration effective to outwardly expand the piston against the sleeve. In the second aspect of the invention, the piston itself has a coefficient of thermal expansion effective to permit it to expand into contact with the sleeve with desired force (even without expansion induced by the connecting member). The piston diameter may be selected relative to the pumping chamber diameter to account for predetermined expansion of the piston that enables the piston to contact the upper and/or lower sleeve. In this design the piston connecting member may be metallic or nonmetallic and may have the same composition as the piston. Other suitable materials for the pump components would be apparent to one skilled in the art in view of this disclosure.

The piston-sleeve force may be selected, by varying composition, size and/or configuration of pump components, so as to be high enough to inhibit molten metal from traveling above the piston, while low enough to avoid excessive wear against the sleeve. The piston-sleeve contact advantageously provides more uniform displacement volumes to be discharged from the pumping chamber. The piston chamber may include an overflow hole(s) 72 for draining molten metal in the event that molten metal passes the piston such as after excessive wear of the pump components. A similar overflow hole(s) 74 is disposed in the valve chamber.

While not wanting to be bound by theory, it may be possible for the piston-sleeve contact to be advantageously maintained despite wear of the sleeve and/or piston, because the piston may continue to expand outwardly even when the sleeve opening increases due to wear. Once the sleeves and piston have eroded/worn excessively, they may be replaced.

The piston connecting member includes a cylinder rod adapter 76, preferably made of steel, having a lower externally threaded portion 78 that is received in the threaded central mounting opening 48 of the piston. A shoulder 80 has diametrically opposed holes 82 for tightening the cylinder rod adapter to the piston with a spanner wrench. Adapter 76 also includes an upper internally threaded opening 84. A steel cylinder rod extension 86 has an internally threaded opening 88 at its lower end which receives a steel threaded rod 90 that is also threaded into the upper opening of the cylinder rod adapter. The cylinder rod extension 86 is fastened to a steel rod of the hydraulic cylinder at its upper end. The actuator is a hydraulic or pneumatic cylinder, such as a compressed air type cylinder. It is preferred to employ two such cylinders, one (50*a*) for actuating the valve and the other (50*b*) for actuating the piston 42.

A clamp 92 has a circumferential protrusion 92*a* received in a circumferential groove 93 of the pump base. Lugs 94 adjustably enlarge or contract the circumferential size of the clamp to secure the clamp around the base and enable efficient detachment when components in the base are in need of repair or replacement. Legs or clamp standoffs 95 are fastened to and extend from the clamp and support an upper platform 96 comprised of an upper steel plate 98 and lower insulation board 100 made of heat insulating material. The hydraulic cylinders are supported on support structure 96 outside the bath.

The piston connecting member is coupled at its upper end in a known manner with an actuating rod of one of the air cylinders, the general location of which is indicated at 102. The valve connecting member is coupled at its upper end in a known manner with an actuating rod of the other of the air cylinders, the general location of which is indicated at 104. The first and second connecting rods may be formed of metal. A suitable shape of the valve chamber, pumping chamber, valve and plunger, is generally cylindrical.

In the shot pump design, the exit passageway or conduit 34 extends to the upper surface of the base. The exit passageway may be formed as a bore in the interior of the base block as shown or it may be a separate conduit that is attached to the base near the outlet opening or in connection with the pumping chamber. An output sleeve 108 made of heat insulating material is received in a counterbore 110 in the base around the through bore. The output sleeve passes through openings 112, 114 formed in the insulation board 100 and plate 98.

Connected to the conduit 34 are a pipe section 116, elbow 118, curved pipe section 120 and straight pipe section 122. The pipe section 116 includes upper and lower flanges 124, 126, the lower flange being fastened to the plate and the upper flange being fastened to a lower flange 128 of the elbow. To an upper flange 130 of the elbow 118 is fastened a flange 132 of the curved pipe section. To the other flange 134 of the curved pipe section is fastened a flange 136 of the straight pipe section 122, which has an exit opening 36 at the discharge location 38 above the shot sleeve. The straight pipe section permits molten metal to be poured or injected into the shot sleeve.

The shot sleeve assembly and die are depicted schematically in the drawings. It will be understood that the shot sleeve and die may include various other components not shown or may include different structures as known to those skilled in the art. In general, a ram 138 is disposed in the shot sleeve so as to travel, upon actuation by a hydraulic cylinder mechanism 139, from an initial position 138*a* upstream of a shot sleeve opening to an advanced position 138*b* downstream of the shot sleeve opening and adjacent the die. Those skilled in the art would appreciate in view of this disclosure that suitable electronics and controllers may be used to fully automate the functioning of the valve piston, pumping piston, ram and die, in accordance with the present invention.

The present invention advantageously permits a metered or predetermined amount of molten metal to be delivered to the shot sleeve. This is accomplished by varying the size of a cavity in the pumping chamber by positioning the piston at a particular generally vertical starting location. The size of this cavity is reduced by moving the starting point of the piston (beginning of down stroke) toward the bottom of the pumping chamber $D_P$, and increased by moving the same upward in the pumping chamber $U_P$.

A removable stop member 106 (e.g., stroke adjustment sleeve) may be used to restrict upward movement of the piston by a distance corresponding to a size and/or location of the stop member. Suitable stop member assemblies are shown in the U.S. Pat. No. 6,793,759 and would be apparent to one of ordinary skill in the art in view of this disclosure.

Actuation of the air cylinders and corresponding movement of the valve and plunger, may be accomplished by hand (whereupon an operator manually moves the handles of the hydraulic cylinders for the plunger and/or the valve), automatically using electronic timing mechanisms (e.g., using limit switches) or semiautomatically. Those skilled in the art would, in view of this disclosure, appreciate various ways to move the valve and piston independently or dependently, in accordance with the present invention. One suitable semiautomatic mechanism for moving the plunger in coordination with the valve is shown in the U.S. Pat. No. 6,293,759 patent .

In general operation, referring to FIG. 1, the valve is lowered when compressed air is sent through line L1 to a location above the piston in the valve air cylinder. Once the valve is in its closed position, molten metal does not enter the valve chamber or pump chamber. Compressed air is sent via line L2 to a location above the piston in the plunger air cylinder, which in turn moves the plunger (piston) downward and forces molten metal from the pumping chamber, through passage 32 and up the conduit 34. In the first aspect of the invention, a metal connecting member 46 expands more than the piston 42 (or in the case of the second aspect of the invention the piston itself expands without need of other influence) which causes the piston to contact the piston chamber wall. As a result, an accurate and reproducible charge or shot of the molten metal travels from the exit passageway, through the pipe section 116, the elbow 118, and the curved pipe section 120, from which it is poured or injected through the straight pipe section 122 and into the shot sleeve opening 140. The pumping chamber may be near atmospheric pressure or, if refractory seals are used as in the U.S. Pat. No. 6,293,759patent, may be injected into a die or the shot sleeve under pressure. A preferred aspect of the invention is that the molten metal may be delivered to the shot sleeve in the cold chamber die process, near atmospheric pressure in the pumping chamber, which results in better safety. Compressed air is then sent via line L3 below the piston of the valve air cylinder, moving the valve up. Compressed air is sent below the piston of the plunger air cylinder via line L4, which causes the plunger to be moved up. The plunger is raised by an amount determined by the position and/or length of the positive stop member 106, to form the cavity of a particular volume that corresponds to an amount of molten metal to be charged into the shot sleeve. The process is then repeated.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A pump for pumping molten metal comprising:

a pump base comprised of non-metallic, heat resistant material, said pump base comprising an inlet opening, a wall forming a pumping chamber, a passageway that communicates said inlet opening with said pumping chamber, and an outlet opening that communicates with said pumping chamber;

a piston made of non-metallic, heat resistant material disposed in said pumping chamber;

a connecting member fastened to said piston;

a valve that permits and restricts flow of molten metal in said pump base; and an actuator connected to said connecting member, said actuator being adapted for effecting reciprocal movement of said piston in said pumping chamber;

wherein said connecting member has a coefficient of thermal expansion and configuration relative to said piston effective to enable said connecting member to expand said piston into contact with said wall.

2. The pump of claim 1 wherein said wall comprises ceramic material.

3. The pump of claim 1 wherein said wall comprises material selected from the group consisting of silicon carbide, silicon nitride and alumina.

4. The pump of claim 1 wherein said piston comprises ceramic material.

5. The pump of claim 1 wherein said piston comprises a material selected from the group consisting of silicon carbide, silicon nitride and alumina.

6. The pump of claim 1 wherein said connecting member comprises metal.

7. The pump of claim 1 wherein said piston and said connecting member are comprised of nonmetallic, heat resistant material.

8. A pump for pumping molten metal comprising:

a pump base comprised of non-metallic, heat resistant material, said pump base comprising an inlet opening, a wall forming a pumping chamber, a passageway that communicates said inlet opening with said pumping chamber, and an outlet opening that communicates with said pumping chamber;

a piston made of non-metallic, heat resistant material disposed in said pumping chamber:

a connecting member fastened to said piston;

a valve that permits and restricts flow of molten metal in said pump base; and an actuator connected to said connecting member, said actuator being adapted for effecting reciprocal movement of said piston in said pumping chamber;

wherein said piston has a coefficient of thermal expansion and configuration effective to enable said piston to expand into contact with said wall during said reciprocal movement of said piston in said pumping chamber, further comprising a gasket comprising non-metallic, heat-resistant material disposed in said pumping chamber.

9. A pump for pumping molten metal comprising:

a pump base comprised of non-metallic, heat resistant material, said pump base comprising an inlet opening, a wall forming a pumping chamber, a passageway that communicates said inlet opening with said pumping chamber, and an outlet opening that communicates with said pumping chamber;

a piston made of non-metallic, heat resistant material disposed in said pumping chamber;

a connecting member fastened to said piston;

a valve that permits and restricts flow of molten metal in said pump base; and an actuator connected to said connecting member, said actuator being adapted for effecting reciprocal movement of said piston in said pumping chamber;

wherein said piston has a coefficient of thermal expansion and configuration effective to enable said piston to expand into contact with said wall during said reciprocal movement of said piston in said pumping chamber;

wherein said wall comprises an upper annular sleeve comprising non-metallic, heat-resistant material disposed along a path of travel of an upper surface of said piston and a lower annular sleeve made of non-metallic, heat resistant material disposed below said upper sleeve in said pumping chamber, and wherein a gasket comprised of non-metallic, heat-resistant material is disposed between said upper sleeve and said lower sleeve.

10. An apparatus for die casting molten metal comprising:

a pump for pumping molten metal comprising:

a pump base comprised of non-metallic, heat resistant material, said pump base comprising an inlet opening, a wall forming a pumping chamber, a passageway that communicates said inlet opening with said pumping chamber, and an outlet opening that communicates with said pumping chamber;

a piston made of non-metallic, heat resistant material disposed in said pumping chamber;

a connecting member fastened to said piston;

a valve that permits and restricts flow of molten metal in said pump base; and an actuator connected to said connecting member adapted to effect reciprocal movement of said piston in said pumping chamber;

wherein said connecting member has a coefficient of thermal expansion and configuration relative to said piston effective to enable said connecting member to expand said piston into contact with said wall;

a conduit extending from said outlet opening to a discharge location outside said base;

a shot chamber that receives molten metal pumped from said conduit at the discharge location; and a ram disposed in said shot chamber and adapted to direct molten metal in said shot chamber to a die for casting said molten metal.

11. The apparatus of claim 10 wherein said conduit is spaced from said shot chamber at the discharge location.

12. The apparatus of claim 10 wherein said conduit is connected to said shot chamber at the discharge location.

13. A pump for pumping molten metal comprising:

a pump base comprised of non-metallic, heat resistant material, said pump base comprising an inlet opening, a pumping chamber, a passageway that communicates said inlet opening with said pumping chamber, and an outlet opening that communicates with said pumping chamber;

a piston comprising non-metallic, heat-resistant material disposed in said pumping chamber, said piston comprising an opening in an upper surface thereof;

a sleeve comprising non-metallic, heat-resistant material disposed in said pumping chamber around said piston;

a metal connecting member disposed in the opening in said piston and connected to said piston;

a valve that permits and restricts flow of molten metal in said pump base; and at least one actuator connected to said connecting member adapted for effecting reciprocal movement of said piston in said pumping chamber;

wherein said connecting member and said piston have relative coefficients of thermal expansion and configurations effective to enable said connecting member to expand said piston into contact with said sleeve during said reciprocal movement of said piston in said pumping chamber.

14. The pump of claim 13 wherein said piston moves along a predetermined axial region of said pumping chamber and said metal connecting member engages said piston proximate to said region.

15. The pump of claim 13 wherein said base comprises graphite, and said sleeve and said piston comprise a material selected from the group consisting of silicon carbide, silicon nitride and alumina.

16. An apparatus for die casting molten metal comprising:

a pump for pumping molten metal comprising:

a pump base comprised of non-metallic, heat resistant material, said pump base comprising an inlet opening, a wall forming a pumping chamber, a passageway that communicates said inlet opening with said pumping chamber, and an outlet opening that communicates with said pumping chamber;

a piston made of non-metallic, heat resistant material disposed in said pumping chamber;

a connecting member fastened to said piston;

a valve that permits and restricts flow of molten metal in said pump base;

an actuator connected to said connecting member adapted to effect reciprocal movement of said piston in said pumping chamber; and a gasket comprising non-metallic, heat-resistant material disposed in said pumping chamber;

wherein said piston has a coefficient of thermal expansion and configuration effective to enable said piston to expand into contact with said wall during said reciprocal movement of said piston in said pumping chamber;

a conduit extending from said outlet opening to a discharge location outside said base;

a shot chamber that receives molten metal pumped from said conduit at the discharge location; and a ram disposed in said shot chamber and adapted to direct molten metal in said shot chamber to a die for casting said molten metal.

17. The apparatus of clam 16 wherein said wall comprises an upper annular sleeve comprising non-metallic, heat-resistant material disposed along a path of travel of said piston in said pumping chamber and a lower annular sleeve made of non-metallic, heat resistant material disposed below said upper sleeve in said pumping chamber, wherein said gasket is disposed between said upper sleeve and said lower sleeve.

* * * * *